United States Patent [19]

Graf et al.

[11] Patent Number: 4,944,430

[45] Date of Patent: Jul. 31, 1990

[54] FLUID DISPENSER

[75] Inventors: Lothar Graf, Rielasingen-Worblingen; Leo Maerte, Sipplingen; Thomas Skorka, Radolfzell, all of Fed. Rep. of Germany

[73] Assignee: Ing. Erich Pfeiffer GmbH & Co. KG, Fed. Rep. of Germany

[21] Appl. No.: 83,669

[22] Filed: Aug. 7, 1987

Related U.S. Application Data

[62] Division of Ser. No. 649,514, Sep. 11, 1984, Pat. No. 4,694,977.

[30] Foreign Application Priority Data

Oct. 28, 1983 [DE] Fed. Rep. of Germany ..... 3339180

[51] Int. Cl.[5] ..... B65D 83/00

[52] U.S. Cl. ..... 222/259; 222/285; 222/321

[58] Field of Search ..... 222/256–257, 222/259–260, 321, 340, 377–380, 383, 386, 387, 336, 282, 285–286; 417/479, 550, 566; 239/321, 331

[56] References Cited

U.S. PATENT DOCUMENTS

| | | | |
|---|---|---|---|
| 1,628,624 | 5/1927 | Liverance, Jr. | 222/378 X |
| 2,299,450 | 10/1942 | Anderson | 222/378 X |
| 2,556,180 | 6/1951 | Hamilton et al. | 222/378 X |
| 3,240,430 | 3/1966 | Diamond | 222/378 X |
| 4,485,943 | 12/1984 | Czech | 222/256 |

*Primary Examiner*—Michael S. Huppert

*Attorney, Agent, or Firm*—Steele, Gould & Fried

[57] ABSTRACT

A vacuum-tight and pressure-tight closed storage space in a container is constructionally combined with a thrust piston pump projecting thereinto and a drag piston slidably guided therein and in the initial position of the thrust piston pump is hermetically sealed by an exhaust valve mechanically closed in forcibly controlled manner. The drag piston is adapted to the thrust piston pump in such a way that the storage space can be emptied substantially free with the thrust piston pump.

32 Claims, 2 Drawing Sheets

FLUID DISPENSER

CROSS REFERENCE TO RELATED APPLICATION

This is a division of application Ser. No. 649,514 filed Sept. 11, 1984, now U.S. Pat. No. 4,694,977.

BACKGROUND OF THE INVENTION

The invention relates to an active substance dispenser with a storage container, a drag piston displaceable therein and tightly sealing the storage space at one end and a piston pump provided at the container end opposite to the drag piston. The piston pump is connected on the outlet side with an active substance discharge opening. The pump cylinder of said piston pump, which receives a displaceable pump piston, is connected on the inlet side to the storage space.

Known active substance or material dispensers of this type are generally used for pasty substances, e.g. toothpaste. The known dispensers are not suitable for active substances to be atomized, e.g. highly fluid substances, such as medical therapeutic and prcphylactic substances or the like. In addition, they are relatively difficult to operate and the discharge pressure is relatively low.

SUMMARY OF THE INVENTION

An object of the invention is to provide an active substance dispenser of the aforementioned type, having a very linear guidance of the active substance from the storage space to the vicinity of the discharge opening. Accordingly, favorable flow conditions and consequently high discharge pressures can be obtained, so that the dispenser can also used for those active substances which are to be atomized on discharge.

In the case of an active substance dispenser of the aforementioned type, the invention achieves its object in that the pump cylinder of the piston pump is substantially axially parallel to the drag piston. The pump cylinder is appropriately of the type that its end remote from the storage space forms the outlet opening of the pump cylinder for the active substance. The remote end of the pump cylinder is usually open but is closed by the pump piston. The inner end of the pump cylinder correspondingly forms the inlet opening to the storage space.

Spatially particularly favorable conditions are obtained if the pump cylinder is arranged coaxially with the drag piston, and particularly where the pump cylinder projects into the storage space and preferably has an intake or suction connection, which is also coaxial with the pump piston, as the end portion projecting furthest into the storage space. Thus, the pump cylinder takes the active substance from the storage space at a deep level, so that said substance only has to form very limited flow presents within the storage space. The suction connection is arranged in overhung manner in the storage space.

According to a particularly advantageous further development of the invention, in the line path between the pump piston and the discharge opening is provided an axially preloaded exhaust valve, which is opened mechanically in a forcibly controlled manner at the end of the piston stroke. A closing part of the exhaust valve is preferably formed by an elastic compression sleeve. An outer end of the sleeve is fixed to the piston shaft with its inner end adjacent to the circular closing part that forms the circular piston. This makes it possible during the pump piston stroke initially to place the active substance in the pump cylinder under a high pressure, without the substance being able to escape. Then, as a result of the mechanical opening of the exhaust valve, the thus-compressed active substance is released in surge-like manner at the associated pump cylinder end and is discharged. This also makes it possible to construct the dispenser in such a way that the active substance cannot come into contact with air within the actual dispenser, which is very important in the case of certain medical substances.

The latter advantages are further improved in that the pump piston engages with an impact shoulder at the end of the piston stroke and that, on opening the exhaust valve, the piston shaft can be moved beyond the stop position of the pump piston.

To ensure that the pump cylinder is reliably tightly sealed from the outside when the dispenser is not in use, i.e. with an unloaded pump piston, the circular closing part of the exhaust valve has a valve closing face located on its inner circumferential face. The closing part is associated with the piston shaft and a stop face located on the outer circumference, and with the pump piston returned, engages under compression and in a sealing manner with an opposite shoulder of the pump cylinder. Thus, with the pump piston returned, the exhaust valve is forcibly and positively kept mechanically closed.

According to a further development of the invention, with the pump piston returned, the pump cylinder is also hermetically sealed in pressure-tight manner relative to the storage space. According to the invention, the closing pressure of the exhaust valve is higher than the maximum pressure in the storage space, so that active substance cannot be discharged from the dispenser unintentionally, i.e. without operating the pump.

If a completely closed annulus, externally defined by the uninterrupted circumferential surface of the pump cylinder, is formed between the piston packing and the seal formed by the stop face and the opposite shoulder, active substance is prevented from externally passing by the piston and consequently cannot pass outwards between the piston shaft and the pump cylinder.

A particularly advantageous further development of the invention results from the fact that the drag piston is cup-shaped, i.e., open and hollow towards the piston pump. The internal contours of the drag piston are substantially precisely adapted to the in particular stepped, tapered outer shape of the piston pump portion projecting into the storage space. This portion fills the drag piston cavity when the storage space is empty. This makes it possible to almost completely empty the storage space, which is particularly desirable with very expensive or, in the case of incorrect use, substances which are highly prejudicial to the environment.

As a result of the dispenser construction according to the invention, a very precise dosing of the active substance quantity discharge per piston stroke is even possible when this quantity is very small, e.g. only a few hundredths of a cubic centimeter. This accurate, repeatable dosing of the discharged substance quantity in the case of a simple dispenser construction is still achieved according to a further development if, towards the end of the return stroke, the pump piston is arranged to uncover a connecting opening between the storage space, which has a variable volume and is closed in a vacuum-tight manner to maintain the complete filling with the stored active substance quantity, and the pump space. The pump space part between the pump end position of the pump piston and the connecting opening defines a space for a measured dose, and the connecting is immersed in this vacuum-tight storage space, at least in the release position thereof. The connecting opening is preferably formed by the open end of the pump cylinder, and the pump piston is completely removed from this part of the pump cylinder towards the end of the return stroke. The open end of the pump cylinder in particularly has a funnel-shaped feed surface for the pump piston. This ensures that during the return stroke of the pump piston and whilst using to the maximum the resulting vacuum, the pump space is only and exclusively filled with the active substance. This is a prerequisite for ensuring that during the return stroke a precisely defined, i.e., accurately dosed quantity always passes in a repeatable manner into the pump space and is then discharged through the discharge opening during the pump stroke. Thus, the dosing quantity can be precisely defined with the size of the pump space part being the controlling volume. Nevertheless, this quantity can be repeatedly discharged in rapid succession. This construction also ensures that during the suction of the active substance into the pump space minimum flow resistances occur. The size of the connecting opening corresponds to the internal cross-section of the pump cylinder, which prevents a surge-like suction of the active substance following the release of the connecting opening. The flow resistances are further reduced by the funnel-shaped feed surface.

It is conceivable to construct a single piston and associated cylinder in such a way that the vacuum formed during the return stroke is adequate to completely fill with active substance the dosing space through the connecting opening. However, in the case of a simple construction of the pump, which is preferably constructed as a manually operable thrust piston pump and may have relatively small stroke paths, this action can be achieved in a particularly advantageous manner in that the pump cylinder is in turn constructed as a double-acting presuction piston. The pump cylinder is guided in an intermediate cylinder connected to the storage space and in particular formed by a neck of the storage container. Preferably, the connecting opening is closed on part of the return travel of the presuction piston and/or the piston sealing face of said presuction piston is provided at the free end of the intermediate cylinder. Thus, before freeing the connecting opening to the active substance, a vacuum is built up in the intermediate cylinder as well as in the pump space, i.e. the device is double-acting. Consequently the intermediate cylinder is filled in such a way that the active substance appears close to the still-closed connecting opening. As soon as during the further course of the return stroke the connecting opening is freed on reaching the maximum vacuum in the pump space, the thus active substance at preliminary vacuum is sucked into the pump space in such a way that its dosing space is reliably completely filled. A structurally simple construction is achieved by arranging the pump piston in a stable manner with respect to the intermediate cylinder and in particular to approximately coaxially position the piston in the cylinder with at least one transfer opening to the storage space between the outer circumference of the pump piston and the inner circumference of the intermediate cylinder. To obtain favorable flow conditions, the overall cross-section of this transfer opening is preferably larger than that of the connecting opening.

The construction according to the invention also makes it possible in a simple manner to provide an in which the dosed discharge quantity can be varied in precisely defined if required. For example, this can be achieved in a simple manner in that the dosing space is made volume-variable. Preferably the end wall of the pump cylinder facing the pump piston is, for example, guided in axially displaceable manner with an outlet socket guided in a control thread of the pump cylinder wall and can e.g. be fixed by self-locking. In this case, the thrust piston pump stroke is limited by the pump piston striking against the facing end wall of the pump cylinder.

To ensure that the driving force acting on the pump piston during the return stroke is accurately fixed the pump piston is spring-loaded towards an initial position and limited by contact at the initial position. The pump cylinder is preferably movably mounted with a handle e.g. a container cap receiving a return spring and covering the pump. The return spring can also be constructed as a resilient element which is integral with at least one of the two components movable with respect to one another. The return spring can in particular be formed by guide arms of the handle, which are under a buckling load and can be outwardly bulged. Thus, according to the invention, the pump piston forms a unit constructionally combined with the storage container and positionally stable with respect thereto. The cylinder and optionally the presuction pump represents the parts to be moved by hand during the pump stroke, which leads to a constructionally very simple construction of the dispenser.

To further simplify the construction of the invention, an exhaust valve is constructed as a check valve, which preferably has an outlet nipple peripherally provided with at least one outlet port and the valve closing part is a valve hose which elastically surrounds the nipple and whose free end can form the outlet port. This ensures that the exhaust valve closes tightly in rapidly responding manner at the end of the active substance discharge or at the beginning of the return travel. This vacuum-tight closure is maintained until the dosing space is filled again or up to the next pump stroke.

For further improving the flow conditions, both when filling the dosing space during the return stroke and on discharging the dosed quantity during the pump stroke, it is advantageous it the line connection between the pump space and the exhaust valve to the latter decreases in cross-section. The line connection is preferably substantially linear and/or has a cross-section completely free within its outer limitation. On further simplifying the dispenser construction, this advantage is further improved if all the essential parts of the dispenser are arranged on a common axis and appropriately have an axially symmetrical construction. This more particularly applies to the pump cylinder, the storage space, the discharge opening, the intermediate cylinder and the handle. The dispenser can in particular have a circular, polygonal or some other cross-section.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 3:
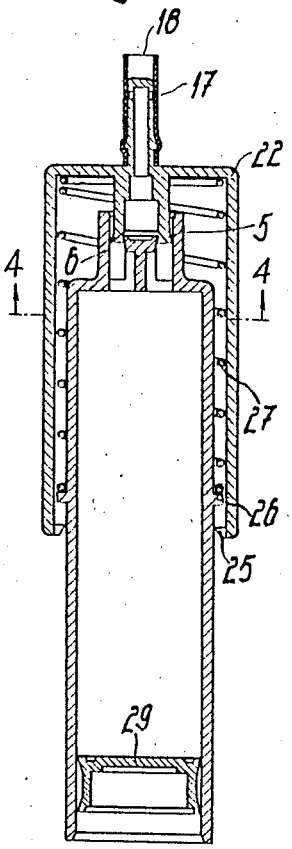
FIGS. 2 and 3 show the active substance dispenser in representations according to FIG. 1, but in other functional positions.

As shown in FIGS. 1 to 5, an active substance dispenser according to the invention has a storage container 2, which is e.g. constructed as a fixed storage vessel, and a thrust piston pump 1, which is also arranged thereon in the form of a cover and which is e.g. positioned at the upper end opposite to the base of the storage container 2.

The thrust piston pump 1, the essential parts of which, or the parts positionally stable with respect to the storage container 2, are constructed in one piece therewith. Pump 1 has a cylinder 3 movable in the longitudinal direction of the storage container 2. Pump 1 is movable with respect thereto by more than the pump stroke. With cylinder 3 is associated a pump piston 4 arranged in positionally stable manner on the storage container 2. At its free end, cylinder 3 is constructed as a presuction piston 5, which is guided in an intermediate cylinder 6 spacedly surrounding the pump piston 4. Intermediate cylinder 6 forms the neck of the storage container 2 provided at the associated end and both the internal cross-sections of intermediate cylinder 6 and those of cylinder 3 are smaller than those of storage container 2. Intermediate cylinder 6 extends up to the associated end wall 7 of the e.g. completely cylindrical storage container 2. The free end of cylinder 6 projects than the pump piston 4 located therein and which is consequently completely located within intermediate cylinder 6. Pump piston 4 is arranged on a cross-shaped piston shaft 8, when viewed in its axial direction, so that four transfer or flow-over openings 9 are formed between the interior of storage container 2 and the cylinder space 10 of intermediate cylinder 6 and are located approximately in the plane of end wall 7.

Presuction piston 5 can be moved approximately up to the free end of intermediate cylinder 6 to the extent that the pump piston 4 is extended completely from the open end of cylinder 3 roughly over the last third of the return stroke, so that its frontal opening facing the pump piston 4 forms a connecting opening 11 open towards cylinder space 10 and shut by action of the pump piston 4 covering and uncovering the opening. This connecting opening 11 is essentially bounded by the narrower end of a feed face 12 for the pump piston 4 which is widened in funnel-space or frustum-shaped manner. The narrower end thereof is directly connected to the piston movement path 13 of cylinder 3 and its wider end is larger than the piston cross-section. In the present represented embodiment, feed surface 12 has a taper angle of approximately 90°.

The e.g. cylindrical piston movement path 13 defines that part of the pump space of the thrust piston pump 1 provided as the dosing spacing 15 because, at the end of the pump stroke, pump piston 4 at least approximately engages on the annular shoulder-shape, frontal end face 14 of the piston movement path 13.

Cylinder 3 is constructionally or integrally joined to an outlet nipple 16, which connects the dosing space 15 to an outlet port 18 for the active substance, which interposing an exhaust valve 17 constructed as a check valve. This line connection 19 is relatively short and substantially linear, its cross-section decreasing in stepped manner towards the check valve 17 and between the later and discharge port 18 widens again. In the represented embodiment, the line connection 19 is formed by a portion which is coaxial with the dosing space 15 with a reduced cross-section compared with the latter, a longer portion following onto the same, whose cross-section is further reduced, and also located in the axis of dosing space 15 and two or more outlet ports in outlet nipple 16 radially opening into the safe. Outlet ports 20 simultaneously form the openings of exhaust valve 17. The latter has as the valve closing part 21 an elastic valve hose which surrounds the outlet nipple 16 over its entire length and which is secured against axial displacement. This valve hose elastically tightly embraces the outlet nipple 16 in the vicinity of the outlet ports 20 located on its periphery and projects over the end of nipple 16 in such a way that with its end it directly forms tee outlet port 18, whose opening cross-section is substantially the same as the largest cross-section of outlet nipple 16.

Cylinder 3 and outlet nipple 16 are provided on the end wall 23 of a handle 22 at right angles to the central axis of the dispenser and are constructed in one part therewith. This handle 22 has several and in the presented embodiment four, uniformly circumferentially distributed guide arms 24 parallel to dispenser 8. These arms peripherally surround the storage container 2 with a limited spacing and their ends are provided with inwardly directed disk cams 25, which are associated with return stroke-limiting stop means 26 and a collar which projects over the outer circumference of storage container 2. Within the guide arms 24 a compression spring is provided as return spring 27, which is on the one hand supported on the inside of end wall 23 and on the other on stop means 26 and circumferentially surrounds container 2 over part of its length. It would also be conceivable in place thereof to fix the ends of guide arms 24 remote from end wall 23 to storage container 2, e.g. by constructing them in one piece and so constructing them with regards to elasticity and strength that they themselves act as return springs. Accordingly during their return travel, they are resiliently curved outwards out of their stretched position.

Opposite to transfer openings 9, the drag piston 29 is freely movably guided with relatively little friction along its cylinder movement path.

On the side of piston 29 remote from storage space 28 storage container 2 is open or is provided with a pressure compensating opening, so that no vacuum can form on this side of piston 29.

Figure 1:
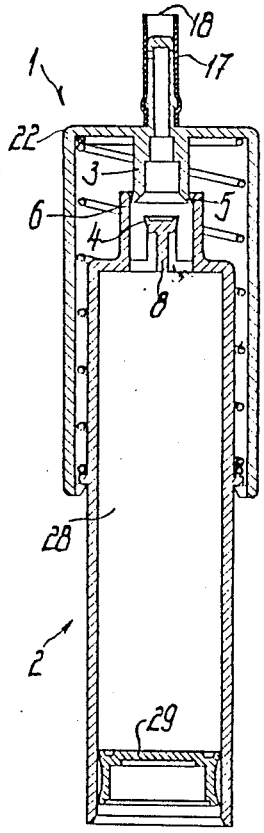
FIG. 1 is an axial section of the active substance dispenser according to the invention.
Figure 4:
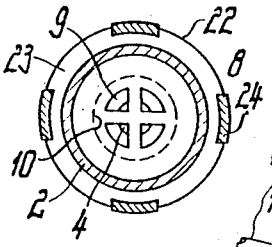
FIG. 4 is a section along line IV—IV of FIG. 3.
Figure 5:
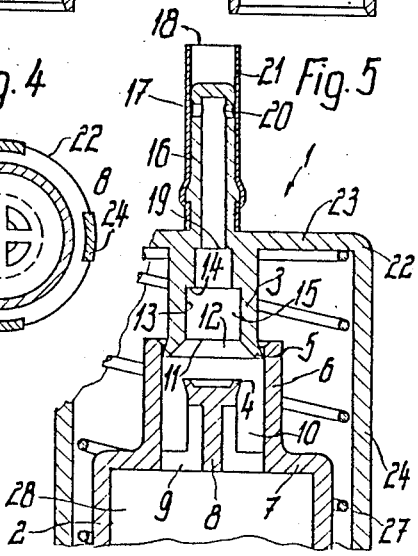
FIG. 5 is a larger scale cut-out from FIG. 1.

In the initial position according to FIG. 1, the storage space 28 including the cylinder space 10, dosing space 15 and the line connection 29, is completely filled with the active substance to be discharged in dosed manner. Cylinder 3 is under the tension of return spring 27 and at the end of its return stroke. If cylinder 3 is now moved in the direction of pump piston 4 counter to the tension of return spring 27, initially part of the active substance quantity in cylinder space 10 is displaced towards the storage space 28 until, along feed surface 12, pump piston 4 reaches the start of the piston movement path 13 of dosing space 15 and has consequently closed the latter. The closing tension of exhaust valve 17 is made sufficiently large that it does not open up to this time. Thus, during this phase, the drag piston is forced back and is loosened if it is stuck. During the further pump stroke, the active substance quantity in the dosing space 15 is placed under pressure by pump piston 4, so that the exhaust valve 17 according to FIG. 2 opens and the dosed active substance quantity is discharged via the line connection 19 of outlet port 18. The complete stroke is e.g. only 5 mm and the storage container 2 of the dispenser, shown in larger scale in FIGS. 1 to 5, contains e.g. only about 4 cc.

Figure 2:
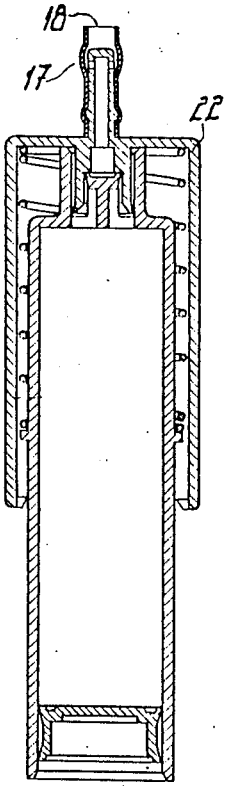

At the end of the pump stroke according to FIG. 2, the exhaust valve 17 automatically closes again through the elastic tension of valve closing part 21. If handle 22 is now released, cylinder 3 according to FIG. 3 is moved back to its initial position under the tension of return spring 27. Presuction piston 15 in intermediate cylinder 6 moves back, as is the case for pump piston 4 and cylinder 3. As a result of the vacuum occurring in intermediate cylinder 6, active substance is sucked from storage space 28 into intermediate cylinder 6. During this return stroke, the pump piston 4 reaches the start of the feed surface 12, whereupon the connecting opening 11 is suddenly released during the further return stroke movement and the maximum possible vacuum is reached at this instant due to the return stroke movement of pump piston 4 in the dosing space 15. As soon as connecting opening 11 is freed, the active substance sucked into intermediate cylinder 6 is sucked in a surge-like and complete filling manner into dosing space 15. Thus, cylinder space 10 occupies the storage space 28 in which the connecting opening 11 is completely immersed during the return stroke. During the return stroke and the resulting suction of the active substance, the drag piston 29 is advanced by a distance corresponding to the dosing quantity through the vacuum formed in the storage space 28, so that although there is a reduction in the volume of the latter, it always remains completely filled.

Figure 6:
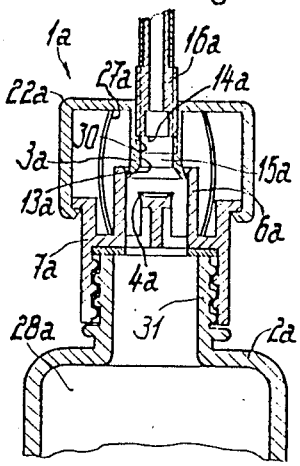
FIG. 6 shows another embodiment in a representation corresponding to FIG. 5.

In FIG. 6, the same reference numerals are used for corresponding parts as in FIGS. 1 to 5, but the letter "a" is added. The thrust piston pump 1*a* of FIG. 6 is constructed so as to be removable from the storage container 2*a* in such a way that it can be refilled with active substance through the container neck 31. To this end, pump piston 4*a* and intermediate cylinder 6*a* are constructionally combined with a collet 7*a*, which can be detachably screwed onto an external thread of the container neck 31, accompanied by the formation of a vacuum-tight closure. In this case, with respect to its return stroke, handle 22*a* is directly stop-limited with respect to collet 7*a*.

In the embodiment of FIG. 6, the outlet nipple is formed by an outlet socket 16*a* provided with an external thread, with which it is adjustable in the direction of the pump stroke, in a control thread 30 provided in wall 13*a* of pump cylinder 3*a*, and is fixably guided and self-locking. The inner end of the outlet socket 16*a* forms the end wall 14*a* of dosing space 15*a* facing pump piston 4*a*, so that adjustment of socket 16*a* makes it possible t vary the size of dosing space 15*a* and consequently the active substance quantity to be discharged.

The active substance dispenser according to the invention is, for example, intended for the dosed discharge of active substances for inhalers or drop dispensers, where a specific number of liquid drops are to be discharged per pump stroke. However, it can be used for agents other than medicaments.

Figure 8:
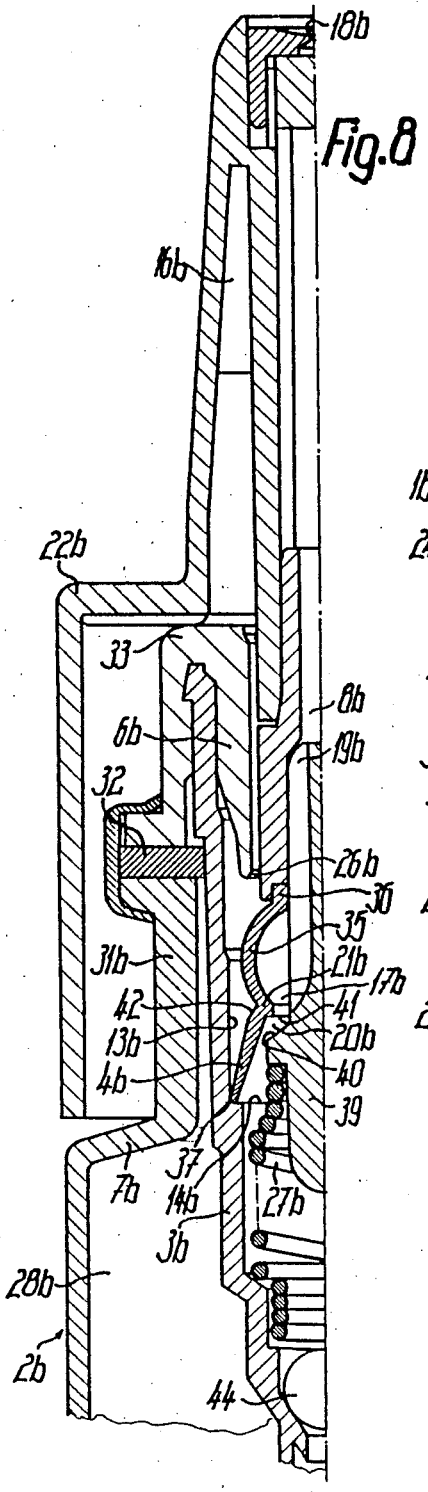
FIG. 8 is a larger scale cutout of FIG. 7 and at the end of the pump stroke.
Figure 7:
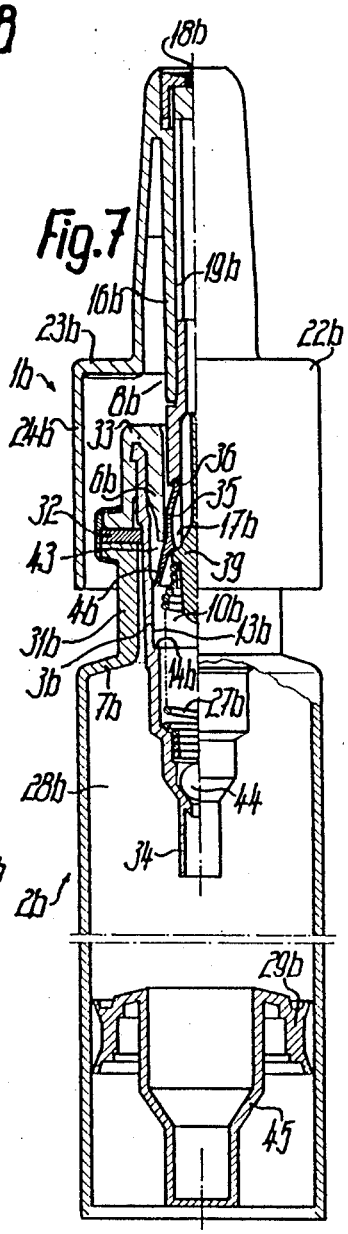
FIG. 7 shows another dispenser embodiment, partly in axial section.

In FIGS. 7 and 8, the corresponding parts are designated by the same reference numerals as in the preceding drawings, but are followed by the letter "b".

The pump of the active substance dispenser according to FIGS. 7 and 8 is a manually operable piston pump 1*b*, which is fixed to a sleeve-like casing part 33 on the end face of neck 31*b* of container 2*b* by a clamping ring. A seal or packing 32 is interposed, whilst all its parts are coaxial with container 2*b*. The outer end portion of cylinder 3*b*, engaging in positive manner between the two sleeves of casing part 33, is fixed to the latter, which is constructed in the manner of two coaxially telescoping sleeves passing into one another on the outer end part, such that the cylinder casing is surrounded by the inner circumference of neck 31*b* with a limited spacing and projects relatively deeply into storage space 28*b* by a suction or intake connection 34 forming its inner tapered end. In the vicinity of neck 31*b*, cylinder 3*b* forms a piston movement path 13*b* for piston 4*b* and which is formed by an inner end portion of a sleeve-like component made from an elastomeric material. The wall thickness of the piston 4*b* is uniformly tapered and is widened in acute-angled frustum-shaped manner in the direction of the pump stroke and its rear end passes in one piece into an annular closing part 21*b* of an exhaust valve 17*b*, which in turn passes into a compression sleeve 35 which can be resiliently shortened by axial pressure on the side remote from piston 4*b*. At the end remote from piston 4*b*, the compression sleeve 35 forms a flanged ring 36 constructed in one piece with piston 4*b*. Sleeve 35 is fixed in a front slot of the piston shaft 8*b*. The outside of compression sleeve 35 is cross-sectionally convexly curved, said curvature increasing during compression or shortening of sleeve 35. The sleeve-like, elastic component is tightly closed between the ring lip-like piston packing 37 provided at the free end of piston 4*b*, directly formed by the latter and tightly engaging on the piston movement path 13*b* and the fixture of the flanged ring 36 in piston shaft 8*b*.

Piston shaft 8*b*, whose interior forms the associated portion of the line connection 19*b* between the cylinder space 10*b* and the discharge port 18*b*, comprises two parts, namely an outer part 38 and a plunger 39 which, over part of the length of part 38, engages in the interior thereof or the end facing container 2*b*, but does not block the line connection. The end slot for receiving flanged ring 36 is provided at the inner end of sleeve-like part 38. In the vicinity of the closing part 21*b*, plunger 39 has an end face which is widened in obtuse-angled, frustum-shaped manner towards the suction connection 34, is directed away from the latter and forms one of the two closing faces, namely the closing face 40 of exhaust valve 17*b*. The inner circumference of closing part 21*b* forms the other valve closing face 41 adapted to cooperate with closing face 40. When the pump is in the initial position and under a relatively high closing pressure, closing face 41 engages on closing face 40 under the force of the compression sleeve 35 serving as the valve closing spring.

The inner sleeve 6*b* of casing part 33, which engages in the rear open end of cylinder 3*b*, forms with its free end located in cylinder 3*b*, an opposite shoulder 26*b* for an annular shoulder-like stop face 22-42. Face 42 is provided on the outer circumference of closing part 21*b* and is cross-sectionally widened in acute-angled, frustum-shaped manner towards the suction connection 34. At the end of the return movement of piston 4b, stop face 42 abuts opposite shoulder 26b, so that the compression sleeve 35 is slightly stretched and the closing part 21b of exhaust valve 17b is forcibly pressed axially against closing face 40 and radially towards the axis of valve 17b, which ensures an extremely tight and reliable closure of valve 17b. Cylinder 3b is constructionally combined in pressure-tight manner with casing part 33, so that in the initial position of piston 4b an annulus 43 is formed on the outside thereof and is located between the piston lip 37 and the valve-like seal formed by the engagement of opposite shoulder 26b on stop face 42.

At the inner end, the piston movement path 13b is interrupted by an annular, inwardly projecting impact shoulder 14b, onto which the free end face of piston 4b abuts at the end of the pump stroke according to FIG. 8. Piston shaft 8b can be moved by a small amount in the direction of the pump stroke beyond this position, in which piston 4b reaches the impact shoulder 14b, so that then the closing face 41 is raised from the valve closing face 40 and an annular passage opening 20b of exhaust valve 17b is freed between these faces. The compression sleeve 35 is elastically resiliently compressed and consequently shortened. At the instant of freeing passage opening 20b, the active substance already pressurized by the preceding pump stroke passes in a surge into the line connection 19b and from there can pass to the outside through discharge port 18b. As soon as piston shaft 8b is released again, it is moved back by the return spring 27b. Exhaust valve 17b initially closes under the restoring force of compression sleeve 35 and then the piston 4b is returned to its initial position. During the return stroke of piston 4b, active substance is sucked into the cylinder space 10b by means of suction connection 34. A check valve 44 is connected thereto and constructed as a ball valve and active substance is consequently made available for discharge during the next pump stroke.

A sleeve-like connecting nipple 16b is mounted with a plug connection on the outer end of the sleeve-like part 38 of piston shaft 8b and forms a one-piece component with a cap-like handle 22b surrounding the same and is arranged with an outer sleeve on the end wall 23b thereof. The discharge opening 18b, which is constructed as an atomizer opening, is located at the free end of nipple 16b, which can be provided with an insert for reducing its internal cross-section and consequently the passage cross-section for the active substance.

A drag piston 29b has an outer piston ring with two circular, tight seal ring lips provided on both ends and an adapting sleeve 45 located therein. An open end face of drag piston 29b faces the piston pump 1b and forms a seal with piston ring 29b. The adapting sleeve 45, is coaxial to the portion of the piston pump 1b projecting beyond the end wall 7b of container 2b into storage space 28b, and has a closed end remote from piston pump 1b located outwardly of the piston ring. The internal cross-sections of the sleeve closely match the outer configuration of the projecting portion of the piston pump 1b. Accordingly in the end position of drag piston 29b associated with the emptied storage space 28b, the projecting portion of piston pump 1b almost completely fills the interior of adapting sleeve 45 and the free end of suction connection 34 engages with the base wall of sleeve 45. In this position, almost the entire surface of the associated end face of drag piston 29b engages with the inside of end wall 7b of container 2b. Thus, the storage space 28b can be completely emptied, with the exception of very small active substance residues.

In the embodiment of FIGS. 7 and 8, it is also particularly advantageous that the product to be atomized, i.e. the active substance, does not come into contact with oxygen prior to discharge, because at no time during the discharge is a connecting channel formed between the container and the external air. In addition, atomization or discharge can take place with the dispenser in any orientation because active substance is always present at the intake connection 34.

We claim:

1. A fluid dispenser for dispensing a fluid, said dispenser comprising:

a storage container (2) defining a storage space (28) for a volume of the fluid;

a piston pump (1) to be operated over a pump stroke cycle from an initial position along a pump stroke to an end position and back to the initial position along a return stroke, said piston pump (1) having a pump piston (4) displaceable relative to a pump cylinder (3) for evacuation of a pump chamber (15) defined by said pump cylinder (3) together with the pump piston (4), said pump chamber (15) being connected via an outlet duct to an external outlet (18);

said pump cylinder (3) having an inlet (11) for the fluid, said inlet (11) being defined by a portion of said pump cylinder (3) connected to the storage space (28);

control means for opening and closing said inlet (11) dependent upon the pump stroke, wherein means are provided for preliminarily sucking the fluid into a vicinity of said inlet (11) during part of said pump stroke cycle, thereby immersing said inlet (11) in preliminarily-sucked fluid during evacuation of said pump chamber (15) until the pump stroke reaches opening of said inlet (11).

2. A fluid dispenser according to claim 1, wherein the inlet (11) is formed by an open end of the pump cylinder (3), the pump piston (4) being completely retracted from the pump cylinder (3) at an end of the return stroke and thereby defining a retracted position, said pump cylinder (3) having a funnel-shaped guide face (12) for receiving the pump piston (4) in an entering movement of the pump stroke, said open end of the pump cylinder (3) being immersed in said preliminarily-sucked fluid in the retracted position of the pump piston (4).

3. A fluid dispenser according to claim 1, wherein said means for preliminarily sucking the fluid include a pre-suction piston (5) guided over a forward and a pre-sucking back stroke in a pre-sucking cylinder (6), said pre-sucking cylinder (6) providing an outlet part of the storage space (28), said means being provided for pre-sucking the fluid before opening of the inlet (11) of the piston pump (1).

4. A fluid dispenser according to claim 3, wherein said pre-sucking piston (5) is provided by said pump cylinder (6), said inlet (11) being closed over part of the back stroke of the pre-suction piston (4) by slide-control means, said pre-suction piston having a sealing face for engaging the pre-sucking cylinder (6), said sealing face being located at a free end of the pump cylinder (3).

5. A fluid dispenser according to claim 3, wherein the pump piston (4) is positionally stable relative to the pre-sucking cylinder (6), said pump piston (5) being positioned substantially coaxially with resect to the pre-sucking cylinder (6).

6. A fluid dispenser according to claim 5, wherein the pump piston (4) is entirely located inside the pre-sucking cylinder (6).

7. A fluid dispenser according to claim 3, wherein the pre-sucking cylinder (6) is made in one piece with the pump piston (4) respective the storage container (2).

8. A fluid dispenser according to claim 3, wherein the pump piston (4) has an outer circumference and the pre-sucking cylinder (6) has an inner circumference, at least one transfer opening (9) being provided between the outer circumference of the pump piston (4) and the inner circumference of the pre-sucking cylinder (6), said transfer opening (9) connecting said outlet part of the storage space (28) to a remainder thereof.

9. A fluid dispenser according to claim 8, wherein said transfer opening has an inner total width larger than an effective cross-sectional width of the inlet (11).

10. A fluid dispenser according to claim 3, wherein said pre-sucking cylinder (6) has an inner width smaller than an inner width of the container (2).

11. A fluid dispenser according to claim 3, wherein said pre-sucking cylinder (6) forms a neck part of the container (2).

12. A fluid dispenser according to claim 1, wherein said pump piston (4) is positionally stable relative to the storage container (2), said pump cylinder (6) being moveably mounted with respect to the container (2).

13. A fluid dispenser according to claim 1, wherein the pump piston (4) is made in one piece with the storage container (2).

14. A fluid dispenser according to claim 1, wherein the pump piston (4) is provided on a profiled shaft (8) bounding transfer openings (9) leading from the storage space (28) to said means for preliminarily sucking the fluid.

15. A fluid dispenser according to claim 1, wherein the pump cylinder (3) provides a dosing chamber (15*a*) defining a dosing volume, means being provided for varying said dosing volume.

16. A fluid dispenser according to claim 15, wherein said pump cylinder (3*a*) has an end boundary (14*a*) facing the pump piston (4*a*), said means provided for varying said dosing volume being arranged for axially adjusting said end boundary (14*a*) with respect to the pump cylinder (3*a*).

17. A fluid dispenser according to claim 1, wherein the pump cylinder (3) is moveably mounted by a handle (22).

18. A fluid dispenser according to claim 17, wherein the handle (22) is cap-like, said handle (22) covering the piston pump (1) respective the container.

19. A fluid dispenser according to claim 1, wherein an outlet valve (17) is provided in the outlet duct.

20. A fluid dispenser according to claim 19, wherein the outlet valve (17) is a check valve.

21. A fluid dispenser according to claim 19, wherein the outlet duct is substantially linear between the pump chamber (15) and the outlet valve (17).

22. A fluid dispenser according to claim 14, wherein the outlet duct decreases in width from the pump chamber (15) towards the outlet valve (17).

23. A fluid dispenser according to claim 1, wherein the outlet duct is substantially empty within a cross-sectional area of an outer boundary.

24. A fluid dispenser according to claim 1, wherein the pump cylinder (3), the storage space (28) and the external outlet (18) are equiaxially arranged with one another and are constructed in axially symmetrical manner.

25. A fluid dispenser according to claim 24, wherein the pre-sucking cylinder (6) and the handle (22) are equiaxially arranged with two relatively displaceable pump units of the piston pump (1).

26. A fluid dispenser according to claim 1, wherein said storage space (28) defines a variable space volume self-adapting in a vacuum-tight manner to a volume of fluid stored therein by means of a drag piston (29) slidably mounted in the container (2) opposite to the means for pre-sucking the fluid.

27. A fluid dispenser according to claim 26, wherein means are provided for moving the drag piston in two opposite directions upon movement of the presuction piston (5).

28. A fluid dispenser for dispensing a fluid, said dispenser comprising:

a piston pump (1*a*) to be operated over a pump stroke cycle from an initial position along a pump stroke to an end position and back to the initial position along a return stroke, said piston pump (1*a*) having a pump piston (4*a*) displaceable with respect to a pump cylinder (3*a*) for evacuation of a pump chamber (15*a*) defined by said pump cylinder (3*a*) together with the pump piston (4*a*), said pump chamber (15*a*) being connected via an outlet duct to an external outlet and defining a chamber volume, wherein said pump cylinder (3*a*) has an end boundary (14*a*) facing the pump piston (4*a*), said end boundary (14*a*) being provided by an outlet socket (16*a*) guided in a control thread (30) of a cylinder wall (13*a*) of the pump cylinder (3*a*), thereby providing means for varying said chamber volume.

29. A fluid dispenser for dispensing a fluid, said dispenser comprising:

a piston pump (1*a*) to be operated over a pump stroke cycle from an initial position along a pump stroke to an end position and back to the initial position along a return stroke, said piston pump (1*a*) having a pump piston (4*a*) displaceable relative to a pump chamber (3*a*) for evacuation of a pump chamber (15*a*) defined by said pump cylinder (3*a*) together with the pump piston (4*a*), said pump chamber (15*a*) being connected via an outlet duct to an external outlet and defining a chamber volume, wherein said pump cylinder (3*a*) has an end boundary (14*a*) facing the pump piston (4*a*), said end boundary (14*a*) being provided by an outlet socket (16*a*) guided in a control thread (30) of a cylinder wall (13*a*) of the pump cylinder (3*a*), and wherein the piston pump (1*a*) provides two pump units, displaceable relative to each other over said pump stroke cycle and spring-loaded relative to each other towards the initial position by means of a return spring (27*a*), said return spring (27*a*) being formed by at least one resilient spring member constructed in one piece with a part of at least one of the two pump units.

30. A fluid dispenser according to claim 29, wherein said return spring is formed by guide arms (24) guiding an operating handle (22) with respect to a storage container (2), said guide arms (24) bulging outwards under a buckling load.

31. A fluid dispenser for dispensing a fluid, said dispenser comprising:

a piston pump (1) to be operated over a pump stroke cycle from an initial position along a pump stroke to an end position and back to the initial position along a return stroke, said piston pump (1) having a pump piston (4) displaceable relative to a pump cylinder (3) for evacuation of a pump chamber (15) defined by said pump cylinder (3) together with the pump piston (4), said pump chamber (15) being connected via an outlet duct to an external outlet and defining a chamber volume, wherein said pump cylinder (3) has an end boundary (14) facing the pump piston (4), said end boundary (14) being provided by an outlet socket (16) guided in a control thread (30) of a cylinder wall (13) of the pump cylinder (3), and wherein an outlet valve (17) is provided in the outlet duct, the outlet valve (17) having an outlet nipple (16) peripherally provided with at least one outlet port (20), a valve closing member (21) formed by a valve hose (21) being provided, said valve closing member (21) elastically embracing the outlet nipple (16) and forming the external outlet (18).

32. A fluid dispenser according to claim 31, wherein said outlet nipple (16) is made in one piece with the cylinder (3) respective the handle (22).

* * * * *